US007567265B2

(12) United States Patent
Ono

(10) Patent No.: US 7,567,265 B2
(45) Date of Patent: Jul. 28, 2009

(54) PRINTING POSITIONING MECHANISM AND PRINTER

(75) Inventor: Katsuhisa Ono, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/404,393

(22) Filed: Apr. 14, 2006

(65) Prior Publication Data

US 2006/0233579 A1 Oct. 19, 2006

(30) Foreign Application Priority Data

Apr. 19, 2005 (JP) ..... P2005-120436

(51) Int. Cl.
*B41J 2/335* (2006.01)

(52) U.S. Cl. ..... 347/197

(58) Field of Classification Search ..... 347/191, 347/197, 198, 218, 220, 222, 176; 400/693, 400/120.01, 120.17

See application file for complete search history.

(56) References Cited

U.S. PATENT DOCUMENTS 5,678,938 A * 10/1997 Saito et al. ..... 400/120.17
6,053,648 A * 4/2000 Mistyurik ..... 400/693

* cited by examiner

*Primary Examiner*—K. Feggins
(74) *Attorney, Agent, or Firm*—Robert J. Depke; Rockey, Depke & Lyons, LLC.

(57) ABSTRACT

A printing positioning mechanism includes a support shaft, a platen supported by the support shaft, and a printing head disposed in an opposing relationship to the platen for movement toward and away from the platen, and adjusts the positional relationship between the printing head and the platen when the printing head is moved toward the plate. The support shaft is movable in a plane perpendicular to an axial direction thereof, and the print head includes an aligning member interlinked with the print head for contacting with an outer periphery of the support shaft when the print head is moved toward the platen. The support shaft is moved to a predetermined position by contacting the aligning member with the outer periphery of the support shaft.

10 Claims, 8 Drawing Sheets

PRINTING POSITIONING MECHANISM AND PRINTER

CROSS REFERENCES TO RELATED APPLICATIONS

The present invention contains subject matter related to Japanese Patent Application P2005-120436 filed with the Japanese Patent Office on Apr. 19, 2005, the entire contents of which being incorporated herein by reference.

BACKGROUND OF THE INVENTION

This invention relates to a printing positioning mechanism for adjusting the positional relationship between a print head and a platen when the print head is moved toward the platen and a printer in which a printing positioning mechanism is used.

Conventionally, in a printer such as, for example, a thermal printer, in order to obtain a high-quality print image, a print head such as thermal head is contacted with a platen under a prescribed pressure. The pressure contact of the thermal head is generally performed such that the thermal head which is mounted for movement into and out of contact with the platen (head down and head up) is uniformly pressed against the platen using a plurality of springs so that printing and transportation can be performed in stability. Therefore, it is a first requirement for maintaining high print quality of the thermal printer to set the thermal head in parallel to the platen.

However, since an installation state of the thermal printer, distortion, warping or the like of the thermal head caused by aged deterioration and so forth have an influence on the platen, pressing force of the thermal head is dispersed among different positions of the platen, resulting in gradual appearance of irregularity of the density or blurring. As a result, the print quality of the thermal head is degraded.

Thus, in order to correct such dispersion of the pressing force of the thermal head as just described, various techniques have been proposed wherein an aligning mechanism is applied to the thermal head so that the thermal head can move following up a fixed position of the platen to maintain a parallel state between the platen and the thermal head.

An apparatus for such aligning of a thermal head as described is disclosed, for example, in Japanese Patent Laid-Open No. Hei 2-113955. In the apparatus, a head supporting member for supporting both sides of a thermal head is formed as a channel-shaped plate, and fitting holes for a support shaft for supporting the thermal head for pivotal motion into or out of contact with a platen through the head supporting member are formed as elongated holes at base portions on the opposite upright sides of the channel-shaped plate. The fitting holes are individually formed so as to extend in a pressing direction of the thermal head against the platen such that the head supporting member can freely move toward the platen. Consequently, automatic aligning of the thermal head can be easily achieved.

Meanwhile, a three-dimensional aligning mechanism is disclosed in Japanese Patent Laid-Open No. 2002-234204. In the three-dimensional aligning mechanism, a fulcrum bearing is set as a center of movement of a thermal head with respect to a support shaft for the thermal head such that the thermal head can be moved not only in a two-dimensional directions including an axial direction of a platen and a direction of movement toward or away from the platen but also in a perpendicular direction to the two-dimensional directions.

However, in both of the apparatus disclosed in Japanese Patent Laid-Open No. Hei 2-113955 and No. 2002-234204, an aligning mechanism is applied to a thermal head, and the thermal head apparently falls into a free state as the aligning mechanism of the thermal head with respect to the platen is provided in an increasing number of directions. Therefore, there is a subject to be solved that accurate setting of the thermal head before a printing operation is performed and fixation and maintenance of the thermal head during printing operation become rather difficult.

Further, even if the accurate setting and so forth of the thermal head can be implemented, since a burden is applied to an assembly of the thermal head for which the precision is required, the failure rate of the thermal head increases and the cost of the thermal printer increases from the complexity of the mechanism of the assembly.

In this manner, both of the prior art apparatus have problems in regard to the reliability and the cost although an aligning mechanism is applied to a thermal head to uniformize the pressing force to a platen to enhance the printing quality.

SUMMARY OF THE INVENTION

In the present invention, it is desirable to provide a printing positioning mechanism wherein a print head can be supported and fixed by a simplified mechanism on a printer such that a platen and the print head can be automatically aligned so as to maintain a parallel state therebetween thereby to achieve both of enhancement of the reliability and reduction of the cost.

In order to attain the desire described above, according to the present invention, there is provided a printing positioning mechanism including a support shaft, a platen supported by the support shaft, and a printing head disposed in an opposing relationship to the platen for movement toward and away from the platen, the printing positioning mechanism being for adjusting the positional relationship between the printing head and the platen when the printing head is moved toward the plate, the support shaft being movable in a plane perpendicular to an axial direction thereof, the print head including an aligning member interlinked with the print head for contacting with an outer periphery of the support shaft when the print head is moved toward the platen, the printing positioning mechanism being configured such that the support shaft is moved to a predetermined position by contacting the aligning member with the outer periphery of the support shaft.

In the printing positioning mechanism, as the print head moves toward the platen (upon a head down movement), the platen attached in a free state to a chassis of a printer is pressed by the print head, whereupon the support shaft of the platen is moved to a predetermined position so that the platen is aligned automatically. In other words, in the printing positioning mechanism, automatic aligning operation is performed principally not by a movement of the print head but by a movement of the platen.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
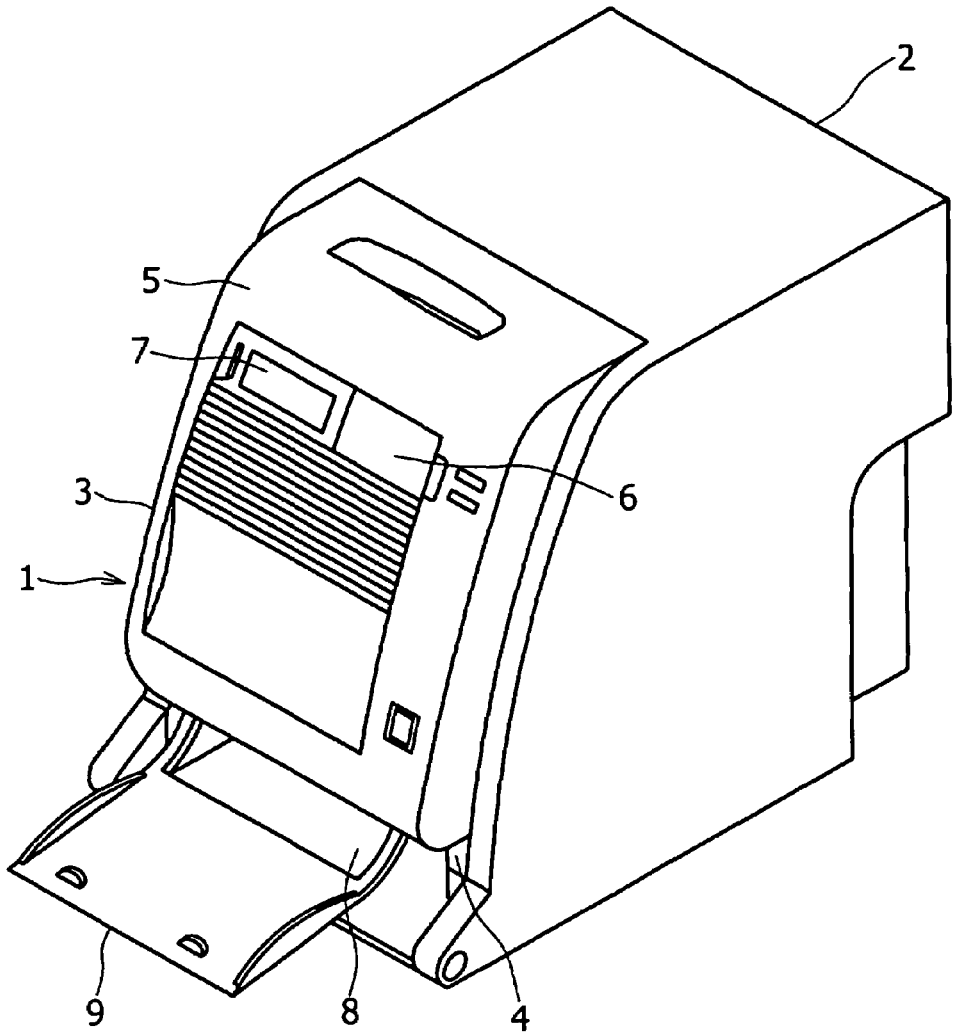
FIG. 1 is a perspective view showing an appearance of a printer to which the present invention is applied.

In a preferred embodiment of the present invention described below, a support shaft 19 functions as a support shaft; a platen 11 functions as a platen; a thermal head 10 functions as a print head; a head support member 17 functions as a head support member for supporting the print head to move toward and away from the platen; and an aligning member 25 functions as an aligning member.

In the following, a preferred embodiment of the present invention is described with reference to the accompanying drawings.

It is to be noted that the printing positioning mechanism of the present invention is incorporated in a printer, and the printer is a thermal printer which includes a thermal head as a print head.

Referring first to FIG. 1, there is shown an appearance of a printer 1 to which the present invention is applied. The printer 1 includes a housing section 2 and a door section 3 attached to the front face of the housing section 2. A power supply switch 4 is provided on the front face side of the housing section 2. Further, a door panel 5 is attached to the door section 3, and an operation panel 6 having various switches and a liquid crystal display panel 7 for displaying various messages thereon are provided on the front face of the door panel 5. Furthermore, a discharged paper tray 9 having a paper outlet 8 is attached to a lower end portion of the door section 3. It is to be noted that a connector connection section (not shown) including a plurality of connectors for external connection is disposed on the rear face side of the housing section 2.

Figure 2:
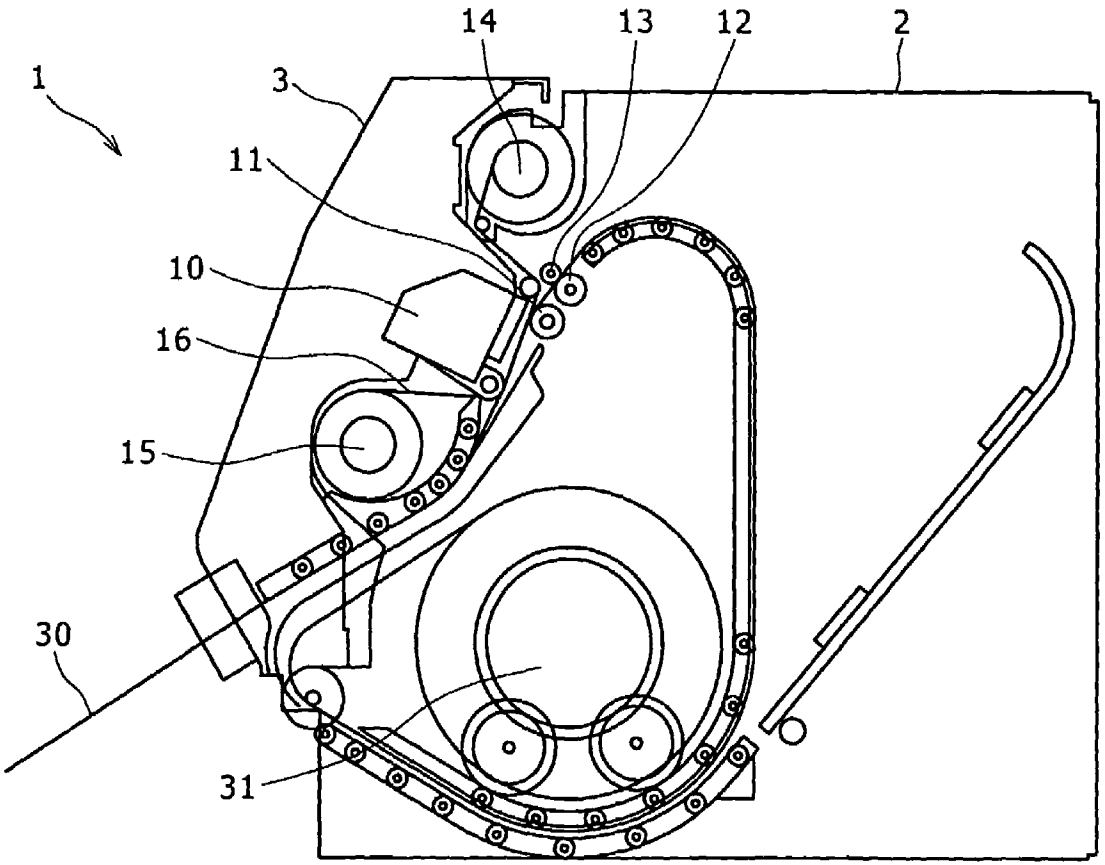
FIG. 2 is a side elevational view showing an internal mechanism of the printer.

FIG. 2 shows an internal mechanism of the printer 1. In the inside of the printer 1, a platen 11 is disposed for rotation in an opposing relationship to a thermal head 10 at a front portion of the housing section 2 which is covered by the door section 3. Further, a grip roller 12 and a pinch roller 13 for driving roll paper 30 to run are provided in the proximity of the platen 11.

Further, takeup spool engaging portions 14 and supply spool engaging portions 15 are disposed for rotation at an upper stage position and a middle stage position, respectively, of the opposite left and right inner side faces of the housing section 2. If a takeup spool for an ink ribbon 16 is engaged with the takeup spool engaging portions 14 and a supply spool is engaged with the supply spool engaging portions 15, then the takeup spool and the supply spool for the ink ribbon 16 are held for rotation in parallel to the platen 11, and the ink ribbon 16 passes on the platen 11. Therefore, when the door section 3 is closed, the ink ribbon 16 is disposed between the platen 11 and the thermal head 10.

The thermal head 10 has a plurality of heat generating resistance members disposed in a line in a widthwise direction (line direction) of the roll paper 30. Heat energy is generated when the heat generating resistance members are energized and is utilized to transfer solid ink applied to the ink ribbon 16 to the roll paper 30 to perform printing.

This is described more particularly. The ink ribbon 16 is delivered from the supply spool by the takeup spool engaging portions 14 which rotate in response to image data to be printed, passes between the platen 11 and the thermal head 10 and then is taken up on the takeup spool. On the other hand, the roll paper 30 is mounted on a paper holder 31 in the housing section 2 and delivered from the paper holder 31. The delivered roll paper 30 is disposed between the platen 11 and the thermal head 10 and is transported by the grip roller 12 and the pinch roller 13.

When printing is not performed, the thermal head 10 is positioned at a raised position in which it is spaced a little away from the platen 11. However, if a printing instruction is inputted, then the thermal head 10 moves down from the raised position until it is pressed against the platen 11, whereupon the ink ribbon 16 and the roll paper 30 are sandwiched by and between the portion of the thermal head 10, at which the heat generating resistance members are disposed, and the platen 11. In other words, the heat generating resistance members of the thermal head 10 are contacted under pressured with the roll paper 30 on the platen 11 with the ink ribbon 16 interposed therebetween.

If image data is inputted in this state, then the grip roller 12 is driven to rotate to successively transport the roll paper 30. Further, the takeup spool engaging portions 14 are driven to rotate to successively take up the ink ribbon 16 at a speed equal to that of the roll paper 30. Simultaneously, the heat generating resistance members disposed on the thermal head 10 are selectively energized by driving control signals so that heat energy is applied from the heat generating resistance members to the ink ribbon 16. Consequently, the solid ink on the ink ribbon 16 is transferred to the roll paper 30 in accordance with the generated heat amount of each of the heat generating resistance members of the thermal head 10 thereby to perform printing. Then, the roll paper 30 after printed is cut at the printed portion thereof by a cutter and discharged from the paper outlet 8.

Since the printer 1 shown in FIGS. 1 and 2 performs printing on the roll paper 30 in such a manner as described above, in order to obtain a print image of high quality, it is necessary to press the thermal head 10 with a prescribed pressure against the platen 11, that is, to set the thermal head 10 at a predetermined position in parallel to the platen 11 so that the pressing force of the thermal head 10 is uniform at all places of the platen 11.

To this end, the printer 1 of the present embodiment includes a printing positioning mechanism as an aligning mechanism for the thermal head 10.

Figure 3:
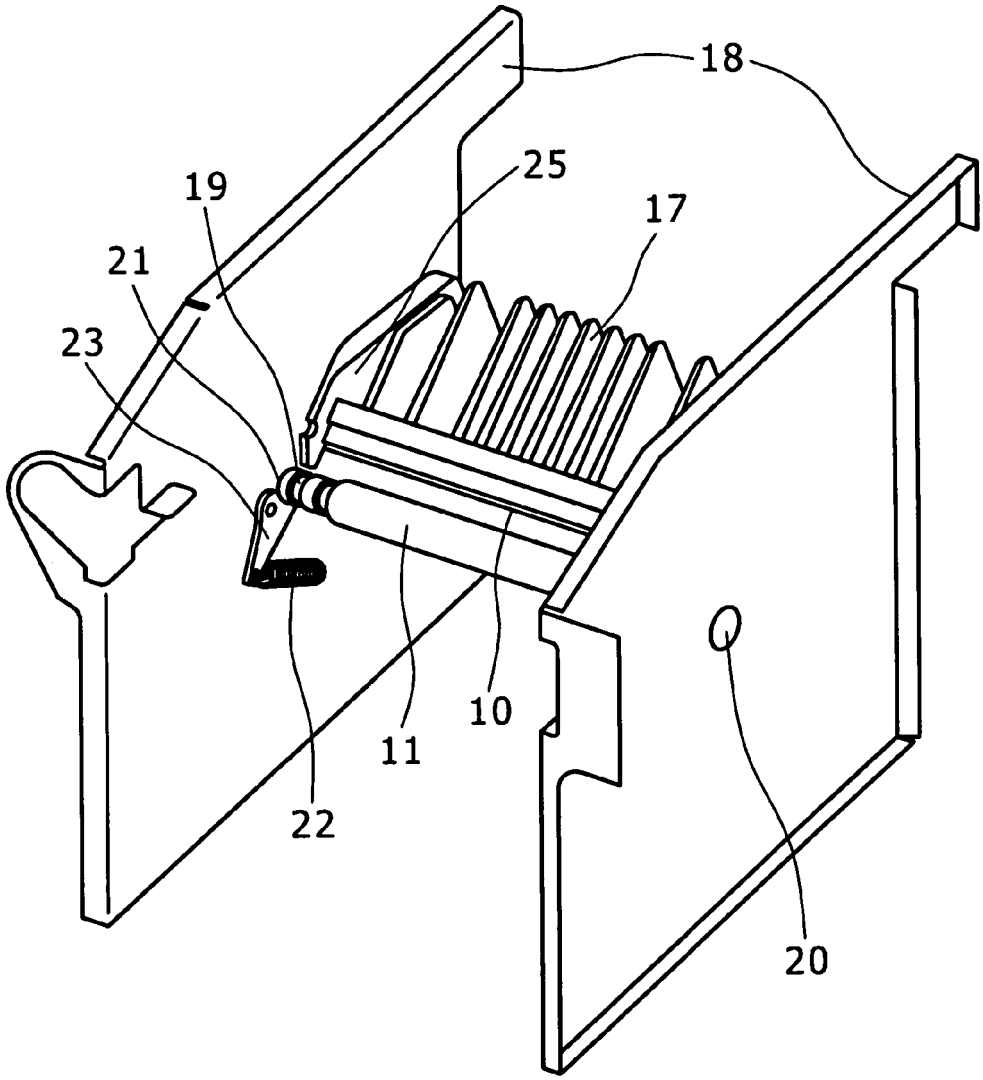
FIG. 3 is a perspective view showing a printing positioning mechanism to which the present invention is applied.

FIG. 3 shows the printing positioning mechanism of the present embodiment (printing positioning mechanism of the printer 1 of the embodiment shown in FIG. 1). Referring to FIG. 3, in the printing positioning mechanism shown, the thermal head 10 is fully secured to a head support member 17 including a heat radiating plate having a large number of fins. The head support member 17 is entirely supported at the opposite ends thereof for pivotal motion on a pair of opposite side walls 18 of a chassis. The head support member 17 is pivoted in a direction toward or away from the platen 11 around an axis of a head support shaft (not shown) serving as a support shaft thereof to perform a head down movement or a head up movement of the thermal head 10.

To this end, the thermal head 10 has such a simple structure that it is supported by the pivotal head support member 17 such that it moves toward or away from the platen 11 by a pivotal motion of the head support member 17. Accordingly, since the thermal head 10 in the printing positioning mechanism of the present embodiment does not freely move in three-dimensional directions as in the prior art apparatus, the thermal head 10 is enhanced in reliability and besides is advantageous also in terms of the cost. It is to be noted that an aligning member 25 is formed integrally with the head support member 17 as hereinafter described.

Meanwhile, the platen 11 is supported for rotation by a pair of ball bearings 21 (which correspond to a second contacting ring) fitted at the opposite ends of a support shaft 19, and the ball bearings 21 are held by a pair of shaft holes 20 formed in the opposite side walls 18 of the chassis. In particular, since the support shaft 19 of the platen 11 is held by the shaft holes 20 through the ball bearings 21, the support shaft 19 and the shaft holes 20 do not slidably contact with each other upon rotation of the platen 11. Consequently, such a situation that such sliding contact between the support shaft 19 and the shaft holes 20 as described above has an influence on the transporting force or the support shaft 19 and the shaft holes 20 are abraded can be prevented.

Further, since the shaft holes 20 are formed in a comparatively great size as hereinafter described, the platen 11 is movable in a plane perpendicular to the axial direction of the support shaft 19 (that is, in a plane of each of the side walls 18 of the chassis) and is biased toward the thermal head 10 by a head up lever 23 (which functions as a pressing member) having a spring 22. Thus, the platen 11 is contacted and moved by the aligning member 25 to perform aligning operation of the platen 11.

Figure 4:
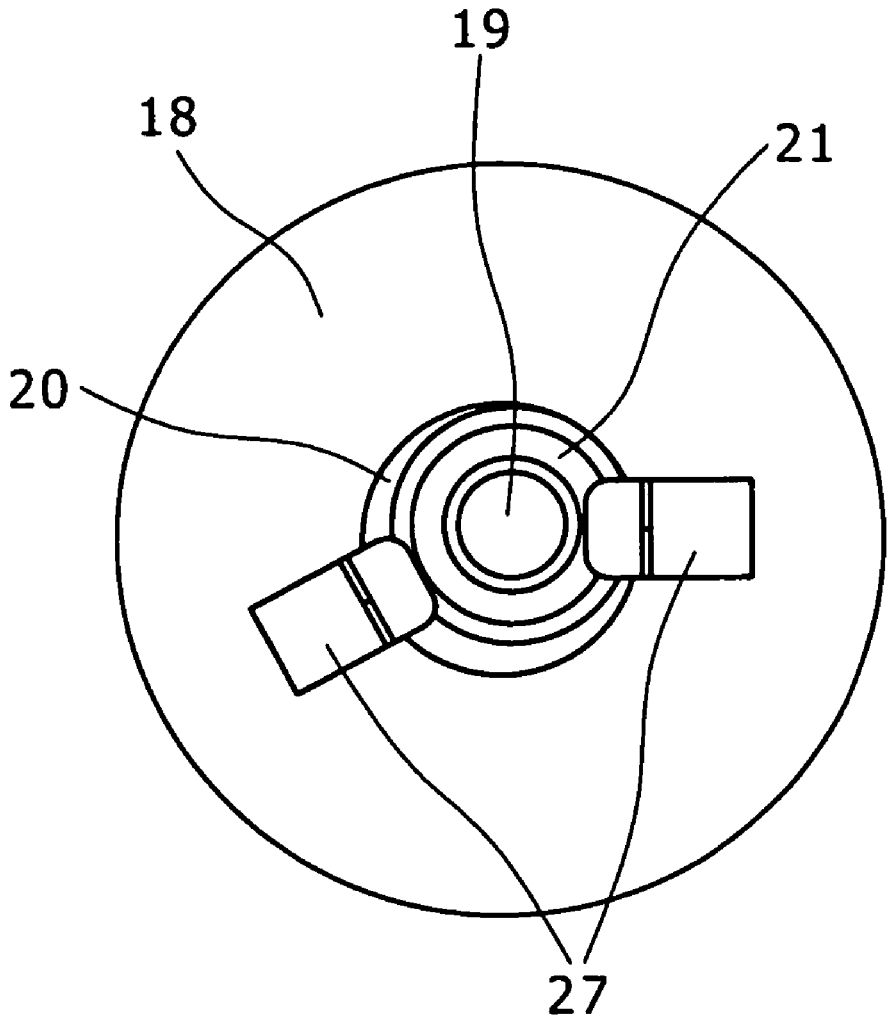
FIG. 4 is a partial sectional view showing a holding section for a platen in the printing position mechanism.

FIG. 4 shows a holding section for the platen 11 in the printing positioning mechanism with regard to one of the side walls 18 of the chassis. Referring to FIG. 4, the shaft hole 20 formed in the side wall of the chassis 18 has a size greater by a predetermined dimension than the outer diameter of the outer race of the ball bearing 21 fitted on the support shaft 19 of the platen 11 such that the support shaft 19 fitted in the shaft hole 20 can be displaced within the shaft hole 20. In other words, the platen 11 is supported in the comparatively great shaft hole 20 such that it contacts with the thermal head 10 while it is positioned at some place within the range of displacement of the shaft hole 20. It is to be noted that a pair of letting off preventing members 27 are attached to the outer side of the shaft hole 20 on the side wall 18 so that the support shaft 19 may not move in the axial direction.

Figure 5:
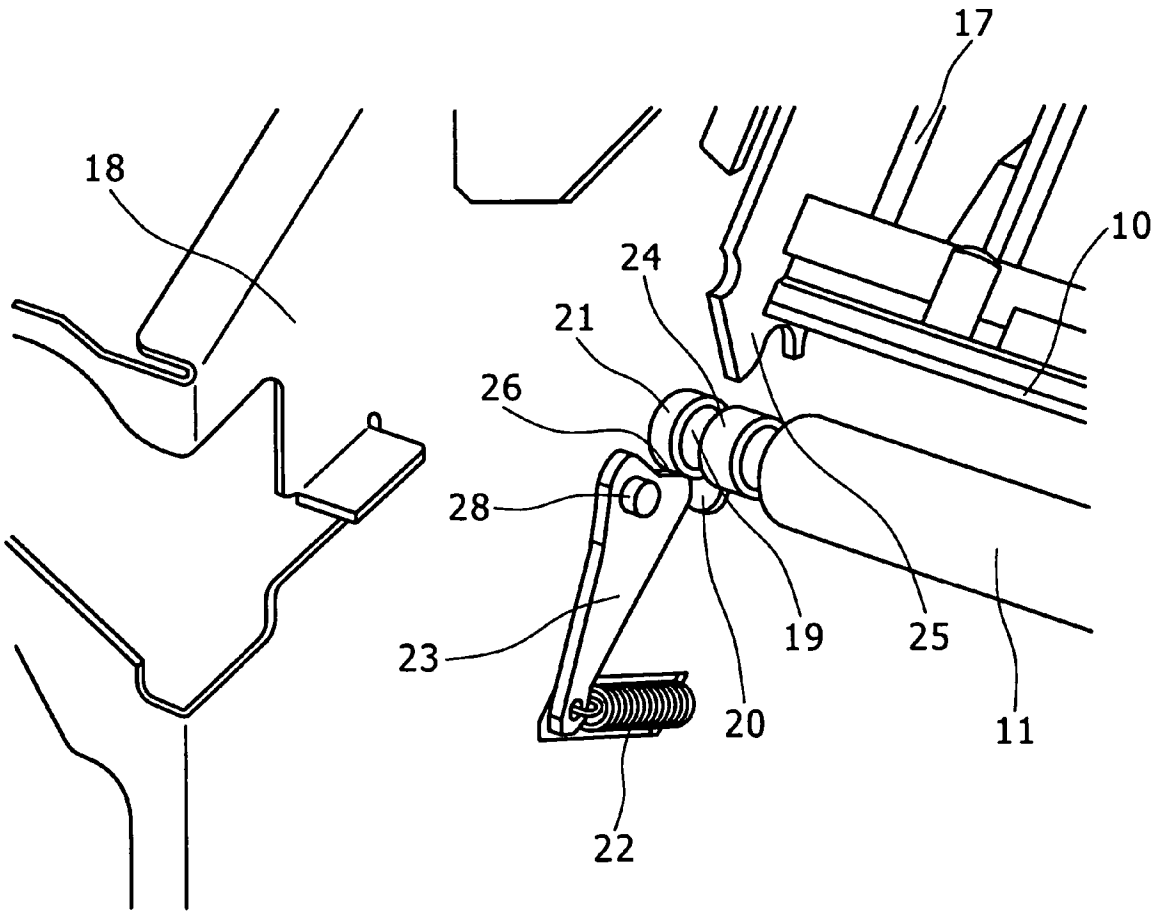
FIG. 5 is a partial perspective view showing the printing positioning mechanism in a head up state of a thermal head.
Figure 6:
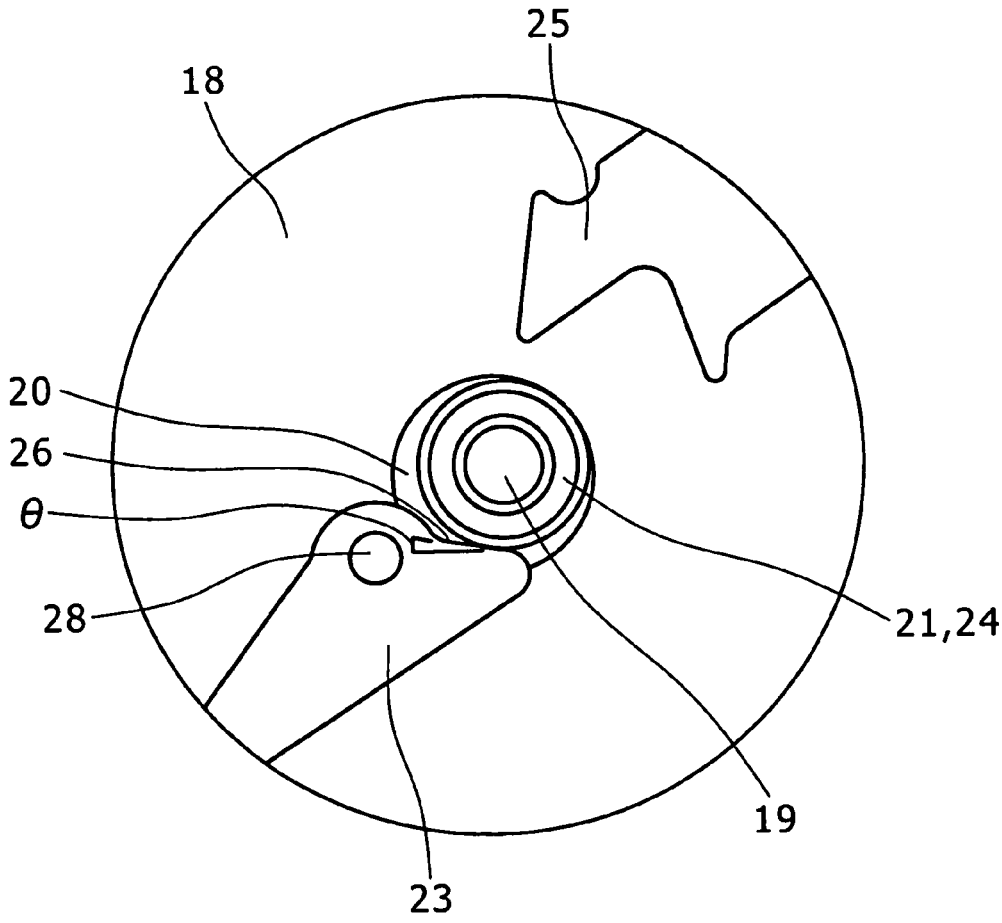
FIG. 6 is a partial side elevational view showing the printing positioning mechanism in a head up state of a thermal head.
Figure 7:
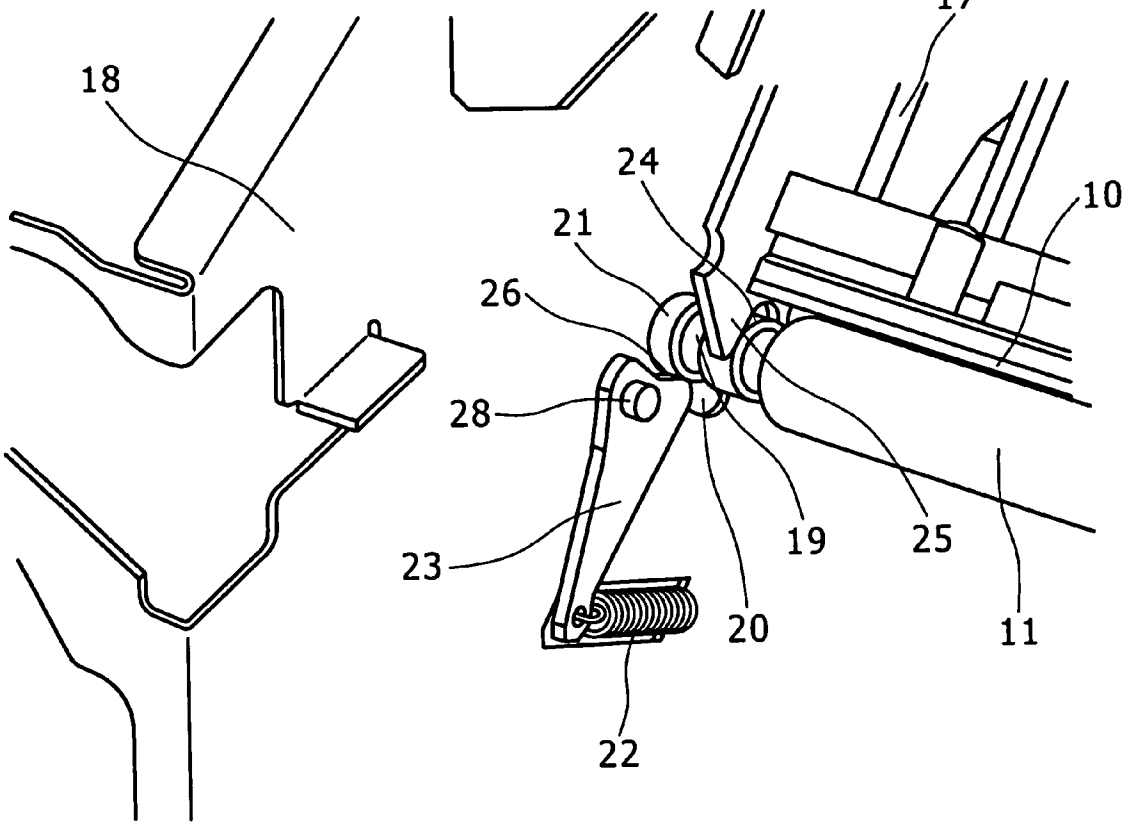
FIG. 7 is a partial perspective view showing the printing positioning mechanism in a head down state of a thermal head.
Figure 8:
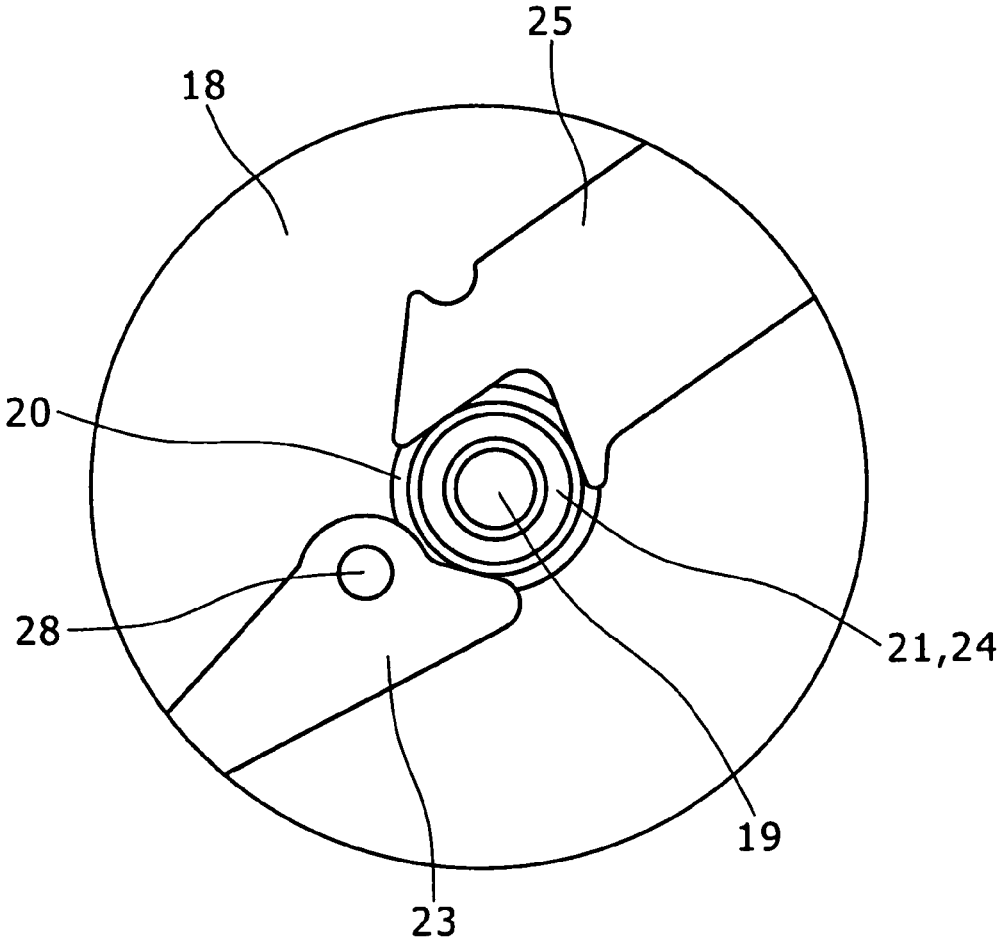
FIG. 8 is a partial side elevational view showing the printing positioning mechanism in a head down state of a thermal head.

FIGS. 5 and 6 show the printing positioning mechanism of the present embodiment in a head up state of the thermal head 10. Meanwhile, FIGS. 7 and 8 show the printing positioning mechanism of the present embodiment in a head down state of the thermal head 10.

Referring first to FIG. 5, the head up lever 23 is attached to the side wall 18 of the chassis below the platen 11. The head up lever 23 is held in contact with an outer periphery of the ball bearing 21 fitted on the support shaft 19 of the platen 11 as seen in FIG. 6 and is normally biased by the spring 22.

The head up lever 23 is a member for transmitting biasing force in a direction to contact the thermal head 10 with the support shaft 19, that is, with the platen 11. In particular, as seen in FIG. 5, the head up lever 23 is supported for pivotal motion around a fulcrum 28 and is pulled at one end thereof by the spring 22 while it contacts at the other end thereof with the ball bearing 21 of the support shaft 19. Therefore, the head up lever 23 biases the platen 11 toward the thermal head 10 without having an influence on the transporting force of the platen 11, and the biasing force depends upon the setting of the spring 22.

The head up lever 23 has an inclined portion 26 formed at a portion thereof at which it contacts with the ball bearing 21. The inclined portion 26 is set such that it has an upwardly inclined face from the upstream toward the downstream of the transport path of the roll paper 30 (refer to FIG. 2). In the present embodiment, the inclination angle θ of the inclined portion 26 with respect to a horizontal plane is 10 degrees as seen in FIG. 6. Thus, the ball bearing 21 is pushed up obliquely by the inclined portion 26 until the outer peripheral face of the ball bearing 21 is contacted with and stopped by an inner peripheral face of the shaft hole 20.

In the head-up state of the thermal head 10, the inclined portion 26 of the head up lever 23 pushes up the ball bearing 21 in this manner. Therefore, the support shaft 19 can conversely be displaced obliquely downwardly (in a direction of movement of the aligning member 25 upon head down movement of the thermal head 10).

Further, the inclined portion 26 of the head up lever 23 acts so that it introduces the aligning member 25 along a route along which the aligning member 25 contacts with a ball bearing 24 (which acts as a first contacting ring) and prevents, even if the ink ribbon 16 (refer to FIG. 2) is pulled by high tension during printing after the thermal head 10 moves down to complete the aligning operation, the support shaft 19 from being defeated by the pull and displaced in the transporting direction of the roll paper 30.

The aligning member 25 has a substantially L-shaped side elevation and is formed integrally with the head support member 17. A pair of such aligning members 25 are disposed on the opposite sides of the head support member 17. Upon a head down movement of the thermal head 10 (upon pivotal motion of the head support member 17), each of the aligning members 25 moves down together with the thermal head 10 until it contacts at two points on the inner side of the L-shape thereof with the outer circumference of the ball bearing 24. Consequently, a reference of the thermal head 10 in the line direction and the axial direction of the platen 11 are aligned with each other by the contact of the aligning member 25 and the ball bearing 24, and positioning of the platen 11 in the line direction is performed.

In particular, when the head support member 17 is pivoted toward the platen 11 to perform a head down movement, the ball bearing 24 of the support shaft 19 is pressed by the aligning member 25 secured to the head support member 17. Consequently, since the support shaft 19 of the platen 11 is held in a free state in the shaft hole 20, the head up lever 23 is pushed down until the support shaft 19 moves to a predetermined position defined by the aligning member 25.

Thereupon, since the portion of the aligning member 25 at which it contacts with the ball bearing 24 is formed as such an inclined face as seen in FIG. 8, the position of the aligning member 25 in the pressing direction and the line direction perpendicular to the pressing direction is restricted to a position parallel to that of the thermal head 10. Accordingly, the platen 11 is positioned following up three-dimensionally against some fine distortion, warping or the like of the thermal head 10. Further, since the aligning member 25 contacts with the ball bearing 24, the support shaft 19 and the aligning member 25 do not slidably contact with each other by rotation of the platen 11.

In this instance, the printing positioning mechanism of the printer 1 of the present invention does not use provision of an aligning mechanism for the thermal head 10 as in the prior art apparatus described hereinabove but uses provision of an aligning mechanism for the platen 11 which is contacted under pressure by the thermal head 10. Therefore, the support shaft 19 of the platen 11 can be displaced within a predetermined range, and the platen 11 can three-dimensionally follow up fine distortion, warping or the like of the thermal head 10 of an object of the pressing. Further, since the shaft hole 20 for supporting the support shaft 19 of the platen 11 can be formed in reduced accuracy with regard to the diameter and the position, it is superior in productivity and facilitates acceptance management thereof.

On the other hand, only it is necessary for the thermal head 10 which is pressed against the platen 11 to be secured with certainty to the head support member 17 and the mechanism therefor is simple in structure in that it includes a comparatively small number of movable parts. Therefore, the reliability and the durability of the thermal head 10 can be enhanced. Accordingly, both of the reliability and the superiority in regard to the cost can be anticipated.

While the present invention has been described in connection with the preferred embodiment thereof, the present invention is not limited to the embodiment described above but allows various modifications such as, for example, those described below.

1. In the embodiment described above, the thermal head 10 is supported by the head support member 17, and the head support member 17 is pivoted to relatively move the thermal head 10 and the platen 11 toward and away from each other. However, alternatively the thermal head 10 itself may be pivoted for such relative movement.

2. In the embodiment described above, the aligning member 25 has an L-shaped side elevation and contacts at two points on the inner side of the L-shape thereof with the outer circumference of the ball bearing 24. However, the shape of the aligning member 25 is not limited to this. In particular, the aligning member 25 may have any other shape only if the support shaft 19 can be moved to a predetermined position when the aligning member 25 is contacted with the outer circumference of the ball bearing 24 (support shaft 19).

3. In the embodiment described above, the support shaft 19 has the ball bearing 21 and the ball bearing 24 thereon, and the aligning member 25 contacts with the outer circumference of the ball bearing 24. Further, the head up lever 23 which has the spring 22 contacts with the outer circumference of the ball bearing 21. However, alternatively the head up lever 23 or the aligning member 25 may contact directly with the support shaft 19.

What is claimed is:

1. A printing device positioning mechanism, comprising:

a support shaft;

a platen supported by said support shaft; and a printing head disposed in an opposing relationship to said platen for movement toward and away from said platen;

said printing device positioning mechanism maintaining a positional relationship between said printing head and said platen when said printing head is moved toward said platen;

said support shaft being movable in a plane perpendicular to an axial direction thereof;

said print head including an aligning member interlinked with said print head for moving said support shaft when said print head is moved toward said platen;

said printing device positioning mechanism being configured such that said support shaft is moved to a predetermined position by said aligning member when said print head is moved toward said platen.

2. The printing device positioning mechanism according to claim 1, wherein said print head is supported by a head supporting member such that said head supporting member is pivotally moved to provide relative motion between said print head and said platen.

3. The printing device positioning mechanism according to claim 1, wherein said aligning member has an L-shaped side elevation and contacts at two points on the inner side of the L-shape directly or indirectly with the outer periphery of said support shaft.

4. The printing device positioning mechanism according to claim 3, wherein a contacting portion of said aligning member has an inclined face.

5. The printing device positioning mechanism according to claim 1, wherein said support shaft has a first contacting ring attached for rotation to said support shaft, and said aligning member contacts with an outer periphery of said first contacting ring.

6. The printing device positioning mechanism according to claim 1, further comprising a pressing member for contacting with the outer periphery of said support shaft to press said support shaft so as to move toward said print head.

7. The printing device positioning mechanism according to claim 6, wherein the portion of said pressing member at which said pressing member contacts with said support shaft has an inclined face.

8. The printing device positioning mechanism according to claim 6, wherein said support shaft has a second contacting ring attached for rotation to said support shaft, and said pressing member contacts with an outer periphery of said second contacting ring.

9. A printer, comprising:

a platen supported by a support shaft;

a print head for pressing a recording object medium transported on said platen to perform printing; and a printing device positioning mechanism for maintaining a positional relationship between said printing head and said platen;

said printing positioning mechanism being configured such that said support shaft is movable in a plane perpendicular to an axial direction thereof, said support shaft and said print head includes an aligning member interlinked with said print head for moving said support shaft such that said support shaft is moved to a predetermined position.

10. The printer according to claim 9, further comprising a pressing member for contacting with the outer periphery of the support shaft to press said support shaft so as to move toward said print head, and the portion of said pressing member at which said pressing member contacts with said support shaft has an upwardly inclined face from the upstream side toward the downstream side of a transporting direction of a recording object medium.

* * * * *